US011091945B2

(12) United States Patent
Fingerle et al.

(10) Patent No.: US 11,091,945 B2
(45) Date of Patent: Aug. 17, 2021

(54) ROLLER CARRIAGE ARRANGEMENT FOR A DOOR OR A WINDOW OF A BUILDING HAVING A FIXED FRAME AND A LEAF WHICH IS DISPLACEABLE RELATIVE TO THE FIXED FRAME

(71) Applicant: ROTO FRANK AG, Leinfelden-Echterdingen (DE)

(72) Inventors: Stefan Fingerle, Reutlingen-Rommelsbach (DE); Thorsten Issler, Buetthard (DE); Markus Peter, Nuertingen (DE); Tamas Nyikos, Sopron (HU); Gyoergy Kiss, Gencsapáti (HU)

(73) Assignee: ROTO FRANK AG, Leinfelden-Echterdingen (DE)

( * ) Notice: Subject to any disclaimer, the term of this patent is extended or adjusted under 35 U.S.C. 154(b) by 289 days.

(21) Appl. No.: 16/315,008

(22) PCT Filed: Jul. 3, 2017

(86) PCT No.: PCT/EP2017/066525
§ 371 (c)(1),
(2) Date: Jan. 3, 2019

(87) PCT Pub. No.: WO2018/007333
PCT Pub. Date: Jan. 11, 2018

(65) Prior Publication Data

US 2019/0309552 A1 Oct. 10, 2019

(30) Foreign Application Priority Data

Jul. 7, 2016 (DE) ..... 10 2016 212 449.8

(51) Int. Cl.
*E05D 15/10* (2006.01)

(52) U.S. Cl.
CPC ..... *E05D 15/1005* (2013.01); *E05D 15/1013* (2013.01); *E05D 2015/1031* (2013.01);
(Continued)

(58) Field of Classification Search
CPC . E05D 15/1005; E05D 15/1013; E05D 15/10; E05D 15/565; E05D 15/0665;
(Continued)

(56) References Cited

U.S. PATENT DOCUMENTS 3,654,732 A 4/1972 Schacht
4,551,945 A * 11/1985 von Resch ..... E05D 15/1013 49/221

(Continued)

FOREIGN PATENT DOCUMENTS

CH 684350 A5 8/1994
CN 101405470 A 4/2009

(Continued)

OTHER PUBLICATIONS

English translation of EP1170448.*

(Continued)

*Primary Examiner* — Justin B Rephann
(74) *Attorney, Agent, or Firm* — Collard & Roe, P.C.

(57) ABSTRACT

A roller carriage arrangement for a door or a window of a building, wherein the window or the door has a fixed frame and a leaf which can be released from the fixed frame and which can be displaced relative to the fixed frame together with the roller carriage arrangement.

8 Claims, 3 Drawing Sheets

Figure 1:
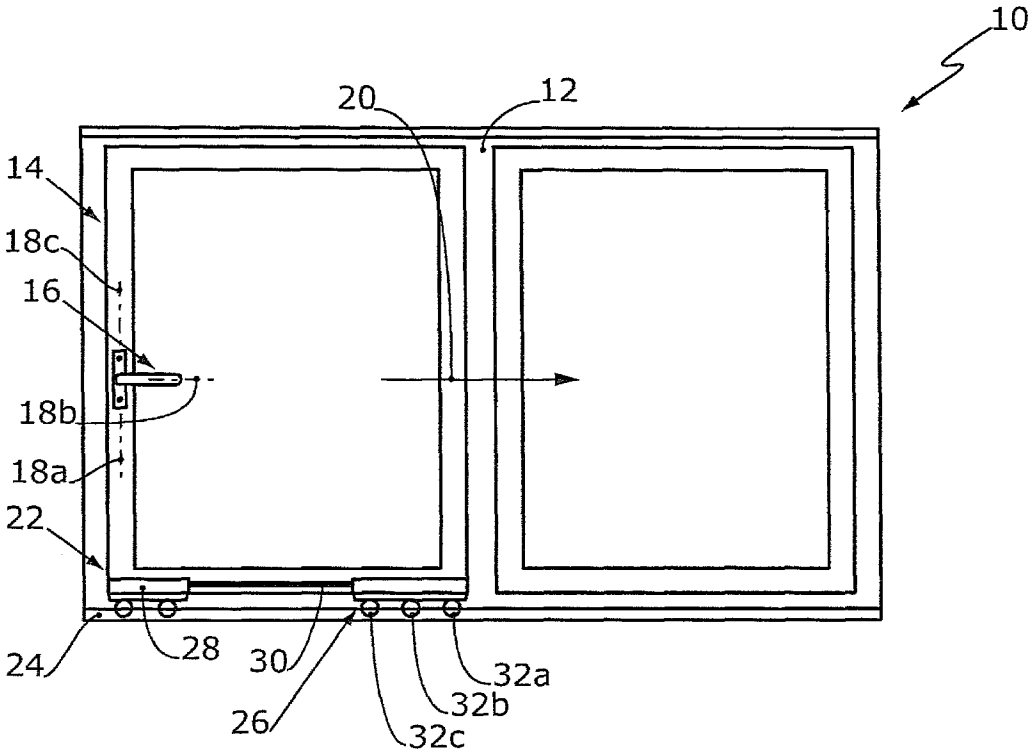

(52) U.S. Cl.
CPC ... *E05Y 2201/686* (2013.01); *E05Y 2900/132* (2013.01); *E05Y 2900/148* (2013.01)

(58) Field of Classification Search
CPC ..... E05D 2015/1031; E05Y 2900/132; E05Y 2900/148; E05Y 2201/64
See application file for complete search history.

(56) References Cited

U.S. PATENT DOCUMENTS

| | | | | |
|---|---|---|---|---|
| 4,574,862 | A | 3/1986 | Rejc | |
| 4,669,219 | A * | 6/1987 | Tomida | E05D 15/1013 49/130 |
| 4,726,145 | A * | 2/1988 | Rokicki | E05D 15/1013 49/220 |
| 4,794,730 | A * | 1/1989 | Fischbach | E05D 15/1013 49/130 |
| 4,802,307 | A * | 2/1989 | Schmidt | E05D 15/1015 49/219 |
| 4,829,710 | A * | 5/1989 | Schmidt | E05D 15/1015 49/125 |
| 4,949,504 | A * | 8/1990 | Bortoluzzi | E05D 15/10 49/130 |
| 5,542,213 | A * | 8/1996 | Freeman | E05D 15/10 49/220 |
| 6,336,246 | B1 * | 1/2002 | Giovannetti | E05D 15/1005 16/87 R |
| 8,087,129 | B2 | 1/2012 | Lambert | |
| 8,959,718 | B2 | 2/2015 | Lambert | |
| 10,597,921 | B2 * | 3/2020 | Alban | E05D 15/0665 |
| 10,718,143 | B2 * | 7/2020 | Tuminella | E05D 15/1042 |
| 2004/0163317 | A1 * | 8/2004 | Reich | E05D 15/565 49/209 |
| 2007/0271850 | A1 * | 11/2007 | Mickelson | E05D 15/565 49/358 |
| 2009/0013605 | A1 * | 1/2009 | Seo | E05D 15/565 49/279 |
| 2009/0038228 | A1 * | 2/2009 | Lee | E06B 3/4627 49/360 |
| 2010/0307064 | A1 * | 12/2010 | Lambertini | E05D 15/565 49/427 |
| 2012/0117759 | A1 | 5/2012 | Lambert | |
| 2012/0117761 | A1 | 5/2012 | Lambert | |
| 2015/0218860 | A1 * | 8/2015 | Goetze | E05B 63/06 292/142 |

FOREIGN PATENT DOCUMENTS

| | | | |
|---|---|---|---|
| DE | 947 535 | | 8/1956 |
| DE | 198 21 870 | A1 | 11/1999 |
| DE | 200 12 165 | U1 | 11/2000 |
| DE | 10 2004 062 764 | A1 | 6/2006 |
| DE | 202009004802 | U1 | 9/2010 |
| DE | 10 2010 036 897 | A1 | 2/2012 |
| DE | 10 2011 000 164 | B3 | 3/2012 |
| EP | 0 092 238 | A1 | 10/1983 |
| EP | 0 222 995 | A2 | 5/1987 |
| EP | 0 360 995 | A1 | 4/1990 |
| EP | 1 170 448 | A1 | 1/2002 |
| EP | 1 645 707 | A1 | 4/2006 |
| EP | 2 586 945 | A1 | 5/2013 |
| EP | 2 690 241 | A1 | 1/2014 |
| GB | 2 239 284 | A | 6/1991 |
| JP | H095258 | A | 1/1997 |
| JP | 2002357048 | A | 12/2002 |
| KR | 1020080013117 | A | 2/2008 |
| WO | 2010069506 | A1 | 6/2010 |

OTHER PUBLICATIONS

Chinese Office Action dated Jul. 13, 2020 issued in the corresponding Chinese Application 201780042141.1 (with English translation).
Chinese Office Action dated Oct. 16, 2020 issued in the corresponding Chinese Application 201780042141.1 (with English translation of relevant parts).
International Search Report of PCT/EP 2017/066525, dated Jan. 23, 2018.
English Translation of International Preliminary Report on Patentability for PCT/EP2017/066525 dated Jan. 10, 2019.
European Search Report dated Sep. 29, 2020 in European Application No. 17 737 527.6 with English translation of the relevant parts.

* cited by examiner

ROLLER CARRIAGE ARRANGEMENT FOR A DOOR OR A WINDOW OF A BUILDING HAVING A FIXED FRAME AND A LEAF WHICH IS DISPLACEABLE RELATIVE TO THE FIXED FRAME

CROSS REFERENCE TO RELATED APPLICATIONS

This application is the National Stage of PCT/EP2017/066525 filed on Jul. 3, 2017, which claims priority under 35 U.S.C. § 119 of German Application No. 10 2016 212 449.8 filed on Jul. 7, 2016, the disclosures of which are incorporated by reference. The international application under PCT article 21(2) was not published in English.

BACKGROUND OF THE INVENTION

The invention relates to a roller carriage arrangement for a door or a window of a building, wherein the window or the door has a fixed frame and a leaf which can be released from the fixed frame and which can be displaced relative to the fixed frame and wherein the roller carriage arrangement has the following:

a) a first roller carriage having a single-piece roller carriage housing;

b) a first roller and a second roller which are arranged on the roller carriage housing and which can be rolled on a sliding rail of the fixed frame;

wherein the roller carriage arrangement in particular has a first coupling rod and a second roller carriage and wherein the second roller carriage is connected indirectly or directly via the first coupling rod to the first roller carriage.

The invention further relates to a door or a window having such a roller carriage arrangement.

It is known to provide roller carriage arrangements for supporting displaceable leaves.

DE 947 535 B discloses a suspension device for door and window leaves, in which two roller carriages have in each case two rollers which are arranged one behind the other, wherein the two carriages are arranged one behind the other and so as to be able to be pivoted relative to each other.

The known suspension device is thereby capable of following a curved sliding rail without becoming jammed.

KR 1020080013117 A discloses a lifting device for a sliding door, wherein the lifting device has a plurality of rollers which are arranged in series.

DE 10 2010 036 897 A1 discloses a modular sliding door carriage comprising a plurality of roller carriers, which are connected by means of bridges. The roller carriers may have up to three rollers.

EP 2 586 945 A1 discloses a roller carriage with four rollers on two axles. A sliding door leaf can be pivotably secured to the known roller carriage.

U.S. Pat. No. 3,654,732 A discloses a folding sliding door with a plurality of rollers.

DE 10 2004 062 764 A1 discloses another roller carriage for guiding a sliding door in a suspended manner, wherein the known roller carriage has two axles on which a roller is rotatably arranged at the end side in each case. The carriage additionally has two guide rollers which prevent the carriage from lifting off.

DE 198 21 870 A1 discloses a glass folding sliding wall, in which the folding of individual segments is facilitated by means of a rack-and-pinion gear.

EP 0 092 238 A1 discloses a folding door having two segments which are connected to each other in an articulated manner. A first segment is supported directly by means of a door leaf bearing. A second segment is retained by means of a carrier arm.

DE 20 2009 004 802 U1 discloses a guiding arrangement of a sliding door of an item of sliding door furniture. The guiding arrangement has at the lower side thereof and at the upper side thereof roller carriage portions which are connected to each other in each case by means of a connection piece and which each have a guiding lever. Sliding doors are suspended on the guiding levers.

EP 1 645 707 A1 discloses a roller carriage arrangement in which two deployment arms are pivotably arranged on a common profile element.

EP 0 360 995 A1 discloses a roller carriage arrangement for a displaceable closet door.

EP 1 170 448 B1 discloses a generic roller carriage arrangement.

As a result of multiple glazing layers and the desire for large leaves, with at the same time the lowest possible additional costs, there is the requirement for a roller carriage arrangement which, on the one hand, can be produced in a cost-effective manner and, on the other hand, is suitable for supporting very heavy and bulky leaves in a reliable and readily slidable manner.

SUMMARY OF THE INVENTION

An object of the present invention is therefore to provide a roller carriage arrangement which in a structurally simple manner is capable of releasing a heavy leaf from a fixed frame and sliding it. An object of the present invention is further to provide a door or a window with such a roller carriage arrangement.

This object is achieved with a roller carriage arrangement having the features of claim 1, claim 10 and by a window or a door having the features of claim 11. The dependent claims relate to advantageous developments.

The object according to the invention is consequently achieved by a roller carriage arrangement for a door or a window of a building, wherein the window or the door has a fixed frame and a leaf which can be released from the fixed frame and which can be displaced relative to the fixed frame. The roller carriage arrangement has a first roller carriage having a single-component or a single-piece roller carriage housing. A first roller and a second roller are arranged on the roller carriage housing. The fixed frame may have a sliding rail on which the first roller and the second roller can be supported. The roller carriage arrangement has a first coupling rod and a second roller carriage, wherein the second roller carriage is connected indirectly or directly via the first coupling rod to the first roller carriage. The first roller carriage has a first deployment arm and a second deployment arm. The deployment arms are arranged at one end indirectly or directly on the roller carriage housing and can be arranged at the other end indirectly or directly on the leaf. The load of the leaf is discharged via the deployment arms into the roller carriage housing and further into the rollers.

According to the invention, there is consequently provision for the leaf load to be introduced via at least two deployment arms into a single-component roller carriage housing. Tests have shown that there is thereby produced a significantly improved ability to size the roller carriage arrangement. That is to say, as a result of the roller carriage arrangement according to the invention, it is possible with a low material use and thereby low costs to enable a very reliable support of a displaceable leaf.

The leaf can preferably be displaced by the roller carriage arrangement according to the invention in the released position parallel with the fixed frame.

In a preferred embodiment of the invention, the first deployment arm in the assembled state of the roller carriage arrangement can be pivoted parallel with the second deployment arm.

Preferably, in addition to the first roller and the second roller, a third roller is provided on the roller carriage housing. The three rollers are preferably arranged in series in such a manner that they can be supported on the same sliding rail. As a result of three rollers on the same roller carriage housing, the forces which occur as a result of the heavy leaf can be discharged in a particularly effective manner. The three rollers are preferably arranged equidistantly with respect to each other on the roller carriage housing.

Preferably, the roller carriage arrangement has a first retention portion and a second retention portion separated from the first retention portion on the first roller carriage. The first retention portion is preferably constructed in the form of a first profile rail and the second retention portion is preferably constructed in the form of a second profile rail. Both retention portions are each arranged independently of each other on a deployment arm. The retention portions can be fixedly mounted on the leaf, in particular screwed to the leaf.

The first carriage is connected via a first coupling rod to a second roller carriage. The second roller carriage has at least one roller. Preferably, the second roller carriage has two rollers. The roller(s) of the second roller carriage is/are preferably constructed for guiding in the same sliding rail as the rollers of the first roller carriage. The second roller carriage facilitates the symmetrical load discharge of the leaf in a particularly effective manner.

In this instance, the second roller carriage may have a third deployment arm of the roller carriage arrangement in order to discharge the leaf load.

In another preferred embodiment of the roller carriage arrangement, the first coupling rod is connected indirectly or directly to a damper of the roller carriage arrangement, wherein the damper is further pivotably arranged on a deployment arm, preferably on the first deployment arm. The damper enables a precise uniform movement of the leaf at the upper and lower side thereof.

The roller carriage arrangement may have a third roller carriage and a second coupling rod, wherein the second coupling rod connects the second roller carriage indirectly or directly to the third roller carriage. The third roller carriage may have at least one roller, in particular two rollers. The roller(s) of the third roller carriage is/are preferably constructed for guiding in the same sliding rail as the rollers of the first roller carriage.

The third roller carriage may have a fourth deployment arm of the roller carriage arrangement in order to discharge the leaf load.

In another preferred embodiment of the roller carriage arrangement, it has a control arm for retaining the roller carriage arrangement in the released position. The control arm is arranged on a deployment arm, in particular on the foremost deployment arm in the sliding/closing direction, preferably on the fourth deployment arm.

The first roller carriage, in particular the deployment arms of the first roller carriage, is/are preferably constructed in contrast without any control arms.

The third deployment arm and the fourth deployment arm are preferably each connected to a retention portion, in particular in the form of a profile rail, which can be mounted on the leaf, in particular screwed to the leaf. In a further preferred manner, the third deployment arm and the fourth deployment arm are connected to the same, that is to say, common retention portion which can be mounted on the leaf, in particular in the form of a profile rail.

The object according to the invention is further achieved by a roller carriage arrangement for a door or a window of a building, wherein the window or the door has a fixed frame and a leaf which can be released from the fixed frame and which can be displaced relative to the fixed frame and wherein the roller carriage arrangement has the following:

a) a first roller carriage with a single-piece roller carriage housing;
b) a first roller and a second roller which are arranged on the roller carriage housing and which can be rolled on a sliding rail of the fixed frame;
c) a first deployment arm of the first roller carriage which is arranged in the region of the first end thereof so as to be able to be pivoted on the roller carriage housing and which, in the region of the second end thereof which is opposite the first end, can be connected to the leaf indirectly or directly in order to discharge the leaf load; wherein the first roller carriage has a third roller which is arranged on the roller carriage housing.

The arrangement of three rollers on the single-piece roller carriage housing of the first roller carriage enables a very uniform discharge of the leaf load in the fixed frame.

Preferably, this roller carriage arrangement is developed according to patent claims 3 to 9. The above statements relating to additional features of the roller carriage arrangement according to patent claim 1 apply accordingly.

The object according to the invention is further achieved by a window or a door of a building having a fixed frame and a leaf which can be released from the fixed frame and which can be displaced relative to the fixed frame, wherein the leaf is supported on the fixed frame via a roller carriage arrangement described above. The leaf can in this instance preferably be displaced parallel with the fixed frame in the released position.

The first deployment arm and the second deployment arm are preferably pivotably arranged in a non-releasable (undetachable) manner indirectly or directly on the leaf.

Other features and advantages of the invention will be appreciated from the following detailed description of a plurality of embodiments of the invention, from the patent claims and with reference to the Figures of the drawings which show details which are significant to the invention. The different features can be implemented individually per se or together in any combinations in variants of the invention. The features shown in the drawings are illustrated in such a manner that the specific features according to the invention can be made clearly visible.

BRIEF DESCRIPTION OF THE DRAWING FIGURES

Figure 2A:
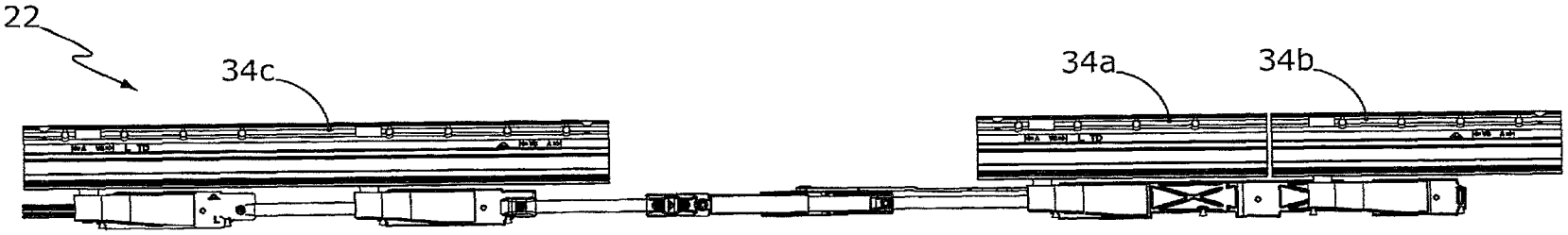
Figure 2B:
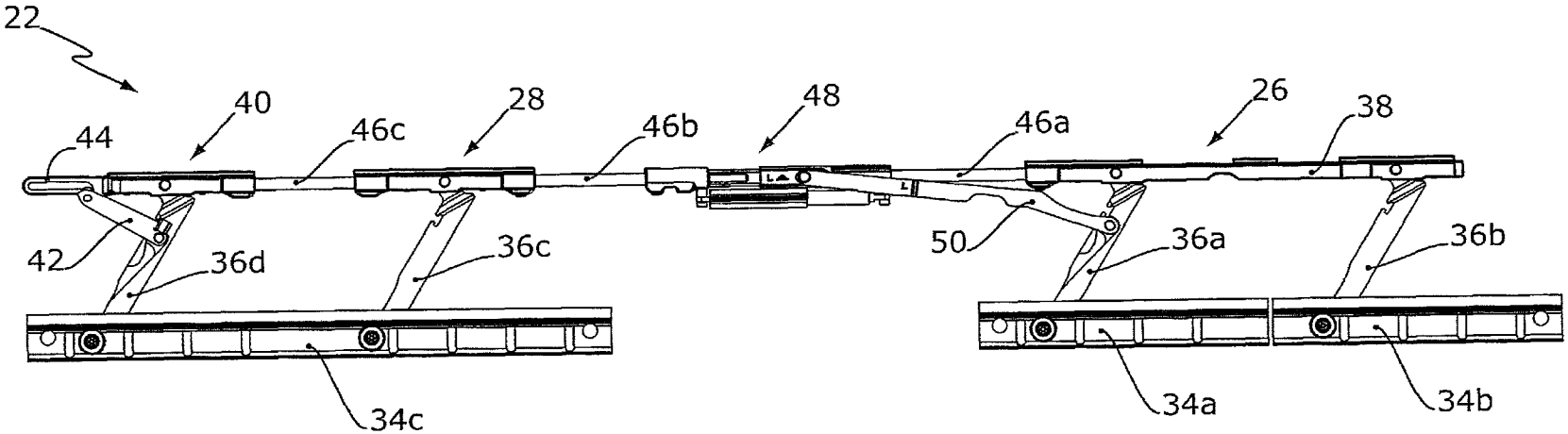

FIG. 1 is a schematic illustration of a door in the form of a sliding door with a roller carriage arrangement;

FIG. 2*a* is a side view of another roller carriage arrangement;

FIG. 2*b* is a plan view of the roller carriage arrangement according to FIG. 2*a;*

Figure 2C:
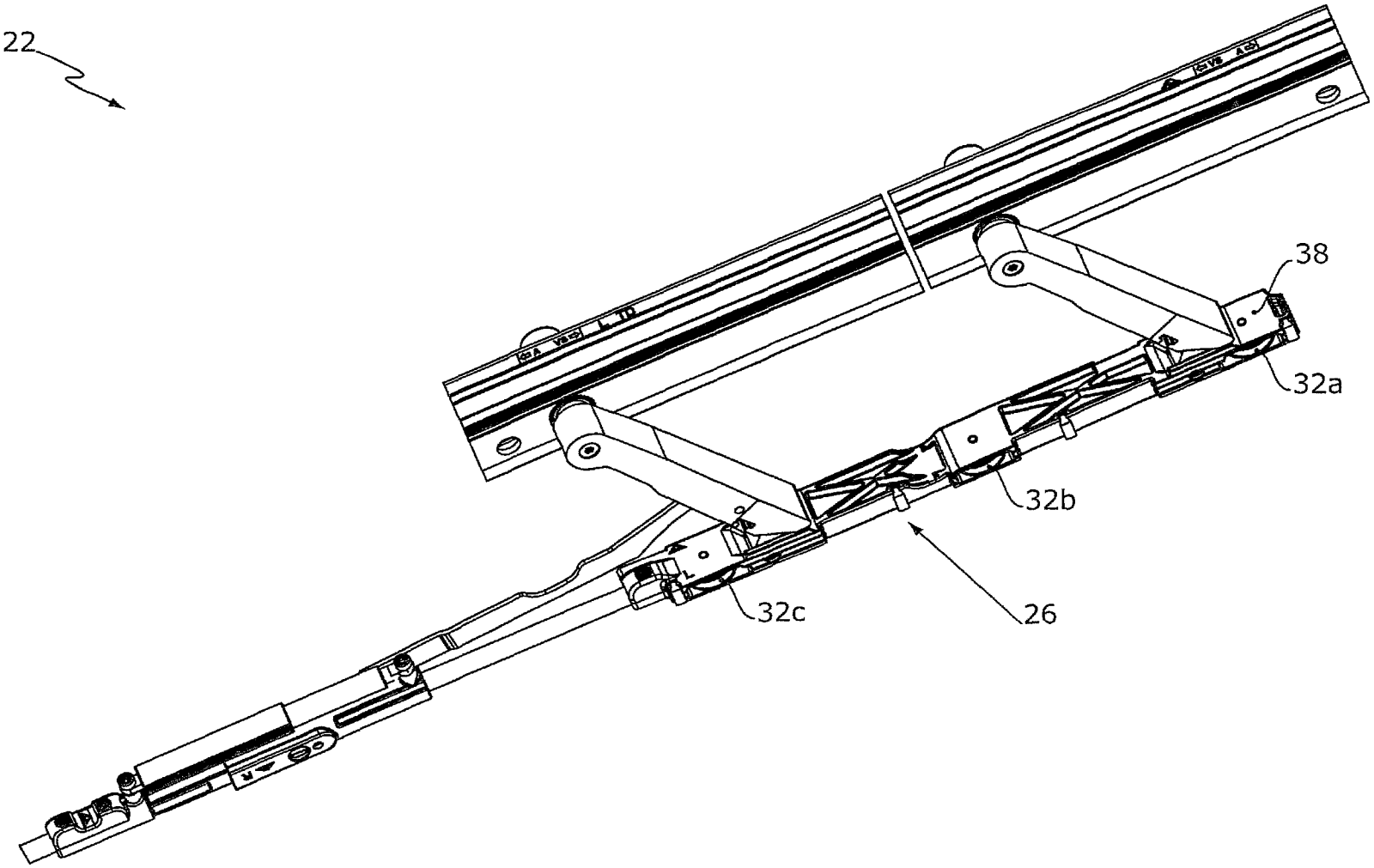

FIG. 2*c* is a perspective view of a portion of the roller carriage arrangement according to FIGS. 2*a* and 2*b*.

DETAILED DESCRIPTION OF THE INVENTION

FIG. 1 shows a door 10 having a fixed frame 12 and a leaf 14 which can be moved relative to the fixed frame 12. A handle 16 is arranged on the leaf 14. In a first handle position 18*a*, the door 10 is closed and the leaf 14 is firmly in abutment with the fixed frame 12. In a second handle position 18*b*, the leaf 14 can be released from the fixed frame 12 and can be displaced in the direction of an arrow 20 parallel with the fixed frame 12. In a third handle position 18*c*, the leaf 14 may be able to be tilted.

In order to move the leaf 14 relative to the fixed frame 12 in the direction of the arrow 20, the leaf 14 is supported at the lower side thereof by means of a roller carriage arrangement 22 on a sliding rail 24 of the door 10. The roller carriage arrangement 22 has a first roller carriage 26 and a second roller carriage 28, which are connected by means of a first coupling rod 30 of the roller carriage arrangement 22. In order to achieve a reliable support of the weight of the leaf 14 on the sliding rail 24, the first roller carriage 26 has three rollers 32*a*, 32*b*, 32*c*. As a result of the distribution of the leaf load over the three rollers 32*a-c* the rollers 32*a-c* are subjected to only a low level of wear. The roller carriages 26, 28 are connected to the leaf 14 in each case by means of a deployment arm (not shown).

FIG. 2*a* is a side view of another roller carriage arrangement 22. FIG. 2*a* shows that the roller carriage arrangement 22 has a first retention member in the form of a first profile rail 34*a*, a second retention member in the form of a second profile rail 34*b* and a third retention member in the form of a third profile rail 34*c* for fixedly connecting the roller carriage arrangement 22 to a leaf 14 (see FIG. 1). The profile rails 34*a-c* are constructed separately from each other.

FIG. 2*b* is a plan view of the roller carriage arrangement 22 according to FIG. 2*a*. FIG. 2*b* shows that the roller carriage arrangement 22 has a first roller carriage 26 whose deployment arms 36*a*, 36*b* are each connected to one of the profile rails 34*a*, 34*b*. The two deployment arms 36*a*, 36*b* are at the other end pivotably arranged on a roller carriage housing 38 of the first roller carriage 26.

The roller carriage arrangement 22 has a second roller carriage 28 and a third roller carriage 40. The second roller carriage 28 is connected to the third profile rail 34*c* via a deployment arm 36*c*, the third roller carriage 40 is connected to the third profile rail 34*c* via a deployment arm 36*d*. The guiding of the deployment arm 36*d* is carried out by means of a control arm 42 of the third roller carriage 40. The control arm 42 is at one end pivotably arranged on the deployment arm 36*d*. At the other end, the control arm 42 is guided in a slotted member 44 of the third roller carriage 40. The control arm 42 can thereby engage in the shown released position of the roller carriage arrangement 22 and can thereby retain the deployment arm 36*d* in a released state.

The connection of the roller carriages 26, 28, 40 is carried out by means of coupling rods 46*a*, 46*b*, 46*c*. A damper 48 is arranged between the coupling rods 46*a*, 46*b*. The damper 48 has a damper arm 50 which is pivotably arranged on the deployment arm 36*a*. The damper 48 damps both the pivoting-in movement of the deployment arm 36*b* and the pivoting-out movement of the deployment arm 36*b*. A uniform inward and outward pivoting of the leaf 14 which can be secured to the profile rails 34*a-c* is thereby achieved (see FIG. 1).

FIG. 2*c* shows the roller carriage arrangement 22 in the region of the first roller carriage 26. In FIG. 2*c*, rollers 32*a*, 32*b*, 32*c* which are arranged on the single-component roller carriage housing 38 can be seen.

When viewing all the Figures of the drawings together, the invention relates in summary to a roller carriage arrangement 22 for a window or a door 10 in the form of a sliding window or a sliding door. A leaf 14 of the window or the door 10 can be released by the roller carriage arrangement 22 from a fixed frame 12 and can be displaced parallel with the main frame plane of the fixed frame 12. The roller carriage arrangement 22 has a first roller carriage 26 which has at least three rollers 32*a-c* on a roller carriage housing 38. Alternatively or additionally, the first roller carriage 26 has at least two deployment arms 36*a, b* on the roller carriage housing 38.

What is claimed is:

1. A roller carriage arrangement for a door or a window of a building, wherein the window or the door has a fixed frame and a leaf which can be released from the fixed frame and which can be displaced relative to the fixed frame, and wherein the roller carriage arrangement comprises following:

a first roller carriage having a single-piece roller carriage housing;

a first roller, a second roller and a third roller which are arranged in series in the roller carriage housing and which are configured to be rolled together on a sliding rail of the fixed frame, a first coupling rod, and a second roller carriage that is connected indirectly or directly via the first coupling rod to the first roller carriage, wherein the first roller carriage has a first deployment arm and a second deployment arm which are each pivotably arranged in a region of first ends thereof on the roller carriage housing and which, in a region of second ends thereof which are opposite the first ends, can be connected indirectly or directly to the leaf in order to discharge a leaf load, wherein the first deployment arm is arranged on the roller carriage housing between the first roller and the second roller, and wherein the second deployment arm is arranged on the roller carriage housing between the second roller and the third roller.

2. The roller carriage arrangement according to claim 1, wherein the second roller carriage has a third deployment arm in order to discharge the leaf load.

3. The roller carriage arrangement according to claim 2, wherein the roller carriage arrangement has a third roller carriage and a second coupling rod, wherein the second coupling rod connects the second roller carriage directly or indirectly to the third roller carriage.

4. The roller carriage arrangement according to claim 3, wherein the third roller carriage has a fourth deployment arm in order to discharge the leaf load.

5. The roller carriage arrangement according to claim 4, wherein a control arm is arranged on one of the deployment arms to retain the roller carriage arrangement in a position released from the fixed frame.

6. The roller carriage arrangement according to claim 4, wherein the roller carriage arrangement has a profile rail for discharging the leaf load, wherein the profile rail is arranged pivotably on the third deployment arm and pivotably on the fourth deployment arm.

7. The roller carriage arrangement according to claim 1, wherein the first coupling rod is connected indirectly or directly to a damper of the roller carriage arrangement, wherein the damper is further pivotably arranged on one of the deployment arms.

8. A window or door of a building having a fixed frame and a leaf which can be released from the fixed frame and which can be displaced relative to the fixed frame, wherein the leaf is supported on the fixed frame via a roller carriage arrangement according to claim 1.

* * * * *